US007773104B2

(12) United States Patent
Chang et al.

(10) Patent No.: US 7,773,104 B2
(45) Date of Patent: Aug. 10, 2010

(54) APPARATUS FOR DRIVING A DISPLAY AND GAMMA VOLTAGE GENERATION CIRCUIT THEREOF

(75) Inventors: Chin-Tien Chang, Tainan County (TW); Ying-Lieh Chen, Tainan County (TW); Lin-Kai Bu, Tainan County (TW)

(73) Assignee: Himax Technologies Limited, Tainan County (TW)

( * ) Notice: Subject to any disclaimer, the term of this patent is extended or adjusted under 35 U.S.C. 154(b) by 745 days.

(21) Appl. No.: 11/531,333

(22) Filed: Sep. 13, 2006

(65) Prior Publication Data

US 2008/0062110 A1 Mar. 13, 2008

(51) Int. Cl.
*G09G 5/10* (2006.01)

(52) U.S. Cl. ..... 345/690; 345/89

(58) Field of Classification Search ..... 345/87, 345/89, 690

See application file for complete search history.

(56) References Cited

U.S. PATENT DOCUMENTS 7,038,646 B2 * 5/2006 Fallot-Burghardt et al. ... 345/89
7,102,604 B2 * 9/2006 Hong ..... 345/87
7,233,305 B1 * 6/2007 Orlando et al. ..... 345/89
7,312,794 B2 * 12/2007 Zehner et al. ..... 345/214
7,538,752 B2 * 5/2009 Chou et al. ..... 345/98
2004/0004498 A1 * 1/2004 Nakao ..... 326/95
2004/0095303 A1 * 5/2004 Moon et al. ..... 345/87
2006/0145982 A1 * 7/2006 Tseng ..... 345/89
2006/0290646 A1 * 12/2006 Kang ..... 345/100
2007/0075957 A1 * 4/2007 Chen et al. ..... 345/98
2007/0075958 A1 * 4/2007 Kim ..... 345/98
2008/0062111 A1 * 3/2008 Chang et al. ..... 345/100

* cited by examiner

*Primary Examiner*—Chanh Nguyen
*Assistant Examiner*—Kwang-Su Yang

(57) ABSTRACT

The present invention discloses an apparatus for driving a display in which each pixels of the display receives a driving voltage and a common voltage, and a luminance of each pixel is determined by a difference between the received driving voltage and the common voltage. The apparatus comprises a plurality of source driver chips, each of which receives a pixel value and generates the driving voltage corresponding to the pixel value according to a plurality of Gamma voltages, wherein at least one of the Gamma voltages is generated by one of the source driver chips.

11 Claims, 5 Drawing Sheets

APPARATUS FOR DRIVING A DISPLAY AND GAMMA VOLTAGE GENERATION CIRCUIT THEREOF

FIELD OF THE INVENTION

The present invention relates to a driving apparatus, and more particularly, to a LCD (Liquid Crystal Display) driving apparatus having gamma or common voltage generation circuits integrated into source drivers.

BACKGROUND OF THE INVENTION

An LCD driving system must include circuits for generation of a common voltage and a group of gamma voltages. Each of the pixels of the LCD panel receives a driving voltage and the common voltage, and a voltage difference therebetween determines the orientation of liquid crystals and therefore the luminance of the pixel. The driving voltages are generated by source drivers. Each source driver receives a pixel value and selects one of the gamma voltages as the driving voltage corresponding to the received pixel value.

FIG. 1 shows a conventional common voltage (denoted as Vcom voltage hereinafter) generation circuit. The conventional Vcom voltage generation circuit is set in a system PCB board. Strings of resistors and a changeable resistor divide the voltage difference between a high reference voltage (denoted as VrefH in FIG. 1) and a low reference voltage (denoted as VrefL in FIG. 1) to generate the Vcom voltage. Then, the Vcom voltage generated is sent out through an output buffer and further to a panel via a tape.

FIG. 2 shows a conventional Gamma voltage generation circuit. The conventional Gamma voltage generation circuit is also set in the system PCB board. Strings of resistors divide the voltage difference between a high reference voltage (denoted as VrefH in FIG. 2) and a low reference voltage (denoted as VrefL in FIG. 2) to generate different Gamma voltages. Then, the Gamma voltages generated are sent out through output buffers and further sent to each source driver chips in a source driver circuit.

Since the Vcom voltage generation circuit and the Gamma voltage generation circuit are set in the system PCB board, the layout of the system PCB board is complicated and is not cost effective.

SUMMARY OF THE INVENTION

Therefore, one objective of the present invention is to provide an apparatus for driving a display to generate at least one Gamma voltage or a common voltage.

Another objective of the present invention is to provide a Gamma voltage generation circuit, located in each source driver chips of a source driver circuit, generating at least one Gamma voltage to send to other source driver chips and to receive other Gamma voltages from other source driver chips.

Still another objective of the present invention is to provide an apparatus for driving a display in which the Gamma voltage is generated according to a chip select control signal and signals sent from a timing controller.

Still another objective of the present invention is to provide an apparatus for driving a display to simplify the layout of the system PCB board and to be cost effective.

According to the aforementioned objectives, the present invention provides an apparatus for driving a display in which each pixels of the display receives a driving voltage and a common voltage, and a luminance of each pixel is determined by a difference between the received driving voltage and the common voltage. The apparatus comprises a plurality of source driver chips, each of which receives a pixel value and outputs the driving voltage corresponding to the pixel value according to a plurality of Gamma voltages, wherein at least one of the Gamma voltages is generated by one of the source driver chips.

According to the preferred embodiment of the present invention, each of the source driver chips generates at least one of the Gamma voltages. Each of the source driver chips comprises a control module generating a selection code and at least one digital-to-analog converter outputting the Gamma voltage according to the selection code. Each of the source driver chips further comprises at least one output buffer receiving the Gamma voltage from the digital-to-analog converter and outputting the Gamma voltage. The control module generates the selection code according to a chip select control signal identifying a chip number of the source driver chip. The control module generates the selection code according to a voltage value output from a voltage selecting module. The voltage selecting module comprises a register and the voltage value is stored into the register according to a control signal sent from a timing controller. The voltage selecting module comprises a one-time-programming (OTP) memory which is programmed to generate the voltage value. The setting of the OTP memory can be programmed according to a register in the voltage selecting module and be fixed through a testing input signal. The voltage selecting module comprises a ROM storing the voltage value. The control module may be a multiplexer. The digital-to-analog converter receives a plurality of reference voltages to generate the Gamma voltage. The digital-to-analog converter has a R2R structure.

According to another objective, the present invention provides a Gamma voltage generation circuit, embedded in a source driver chip. The Gamma voltage generation circuit generates at least one Gamma voltage and comprises a voltage selecting module determining a voltage value, a control module generating a selection code according to the voltage value, and at least one digital-to-analog converter outputting the Gamma voltage according to the selection code.

According to the preferred embodiment of the present invention, the Gamma voltage generation circuit further comprises at least one output buffer receiving the Gamma voltage from the digital-to-analog converter and outputting the Gamma voltage. The control module generates the selection code according to a chip select control signal identifying a chip number of the source driver chip. The voltage selecting module comprises a register and the voltage value is stored into the register according to a control signal. The control signal is sent from a timing controller. The voltage selecting module comprises a one-time-programming (OTP) memory which is programmed to generate the voltage value. The setting of the OTP memory can be programmed according to a register in the voltage selecting module and be fixed through a testing input signal. The voltage selecting module comprises a ROM storing the voltage value. The control module may be a multiplexer. The digital-to-analog converter receives a plurality of reference voltages to generate the Gamma voltage. The digital-to-analog converter has a R2R structure.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
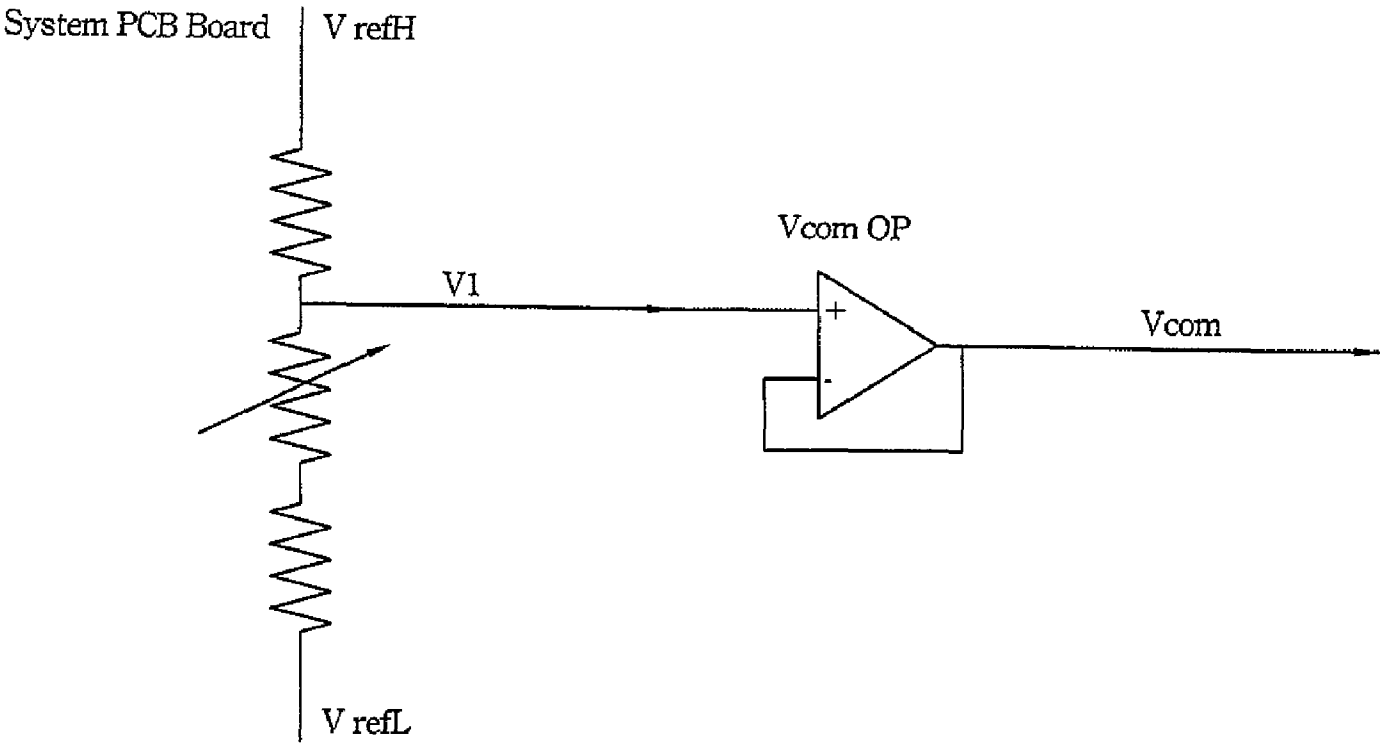
Fig. 1 (Prior Art)
FIG. 1 illustrates a conventional Vcom voltage generation circuit.
Figure 2:
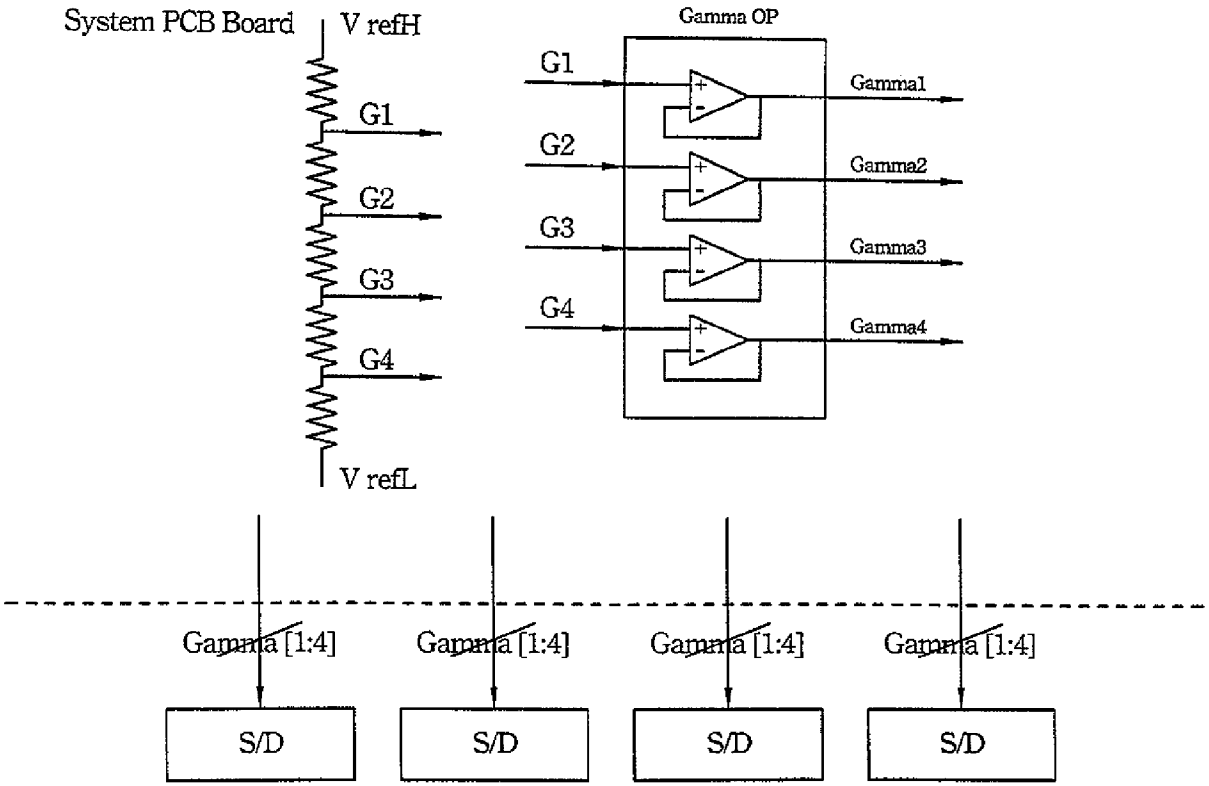
Fig. 2 (Prior Art)
FIG. 2 illustrates a conventional Gamma voltage generation circuit.
Figure 3:
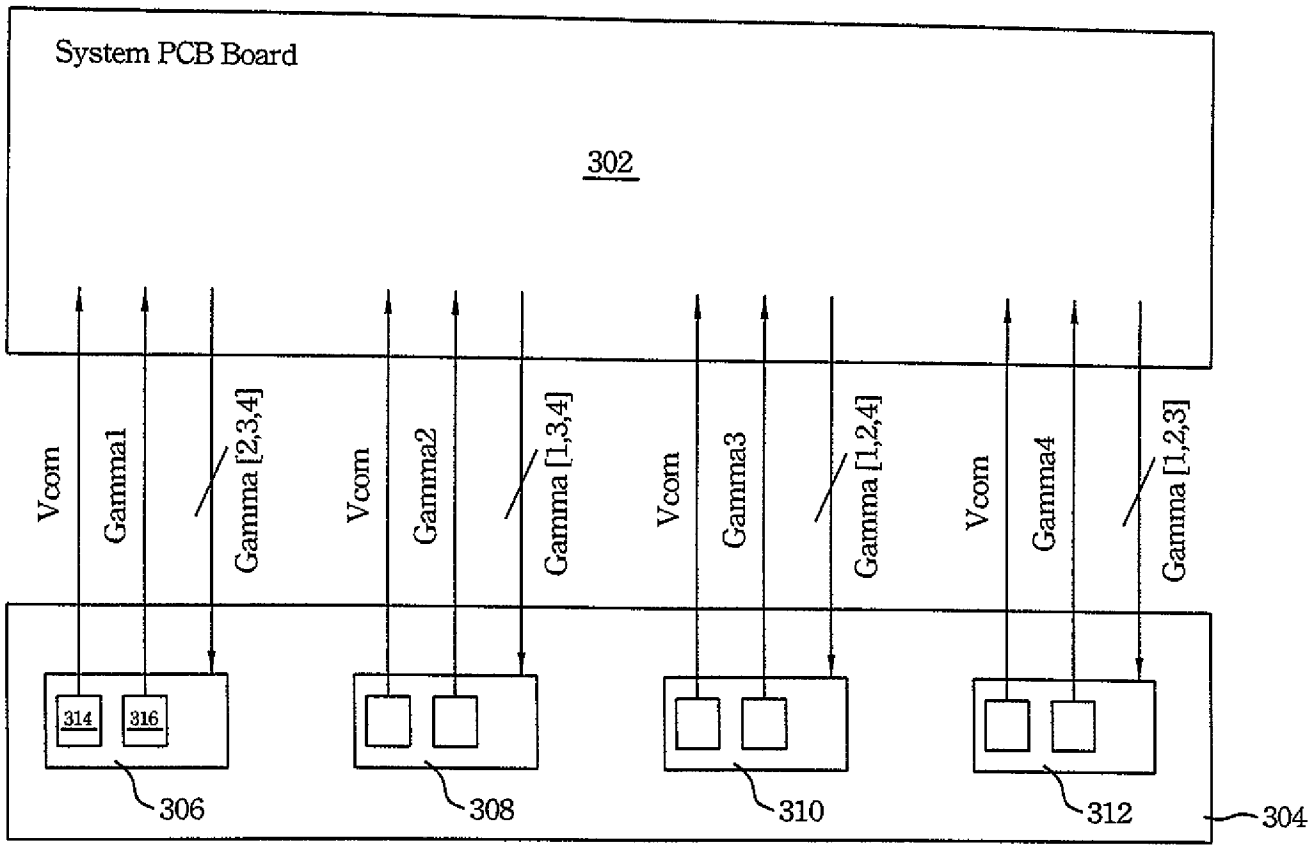
FIG. 3 illustrates a diagram of driving system according to the source driver circuit/chip of the preferred embodiment of the present invention.
Figure 4:
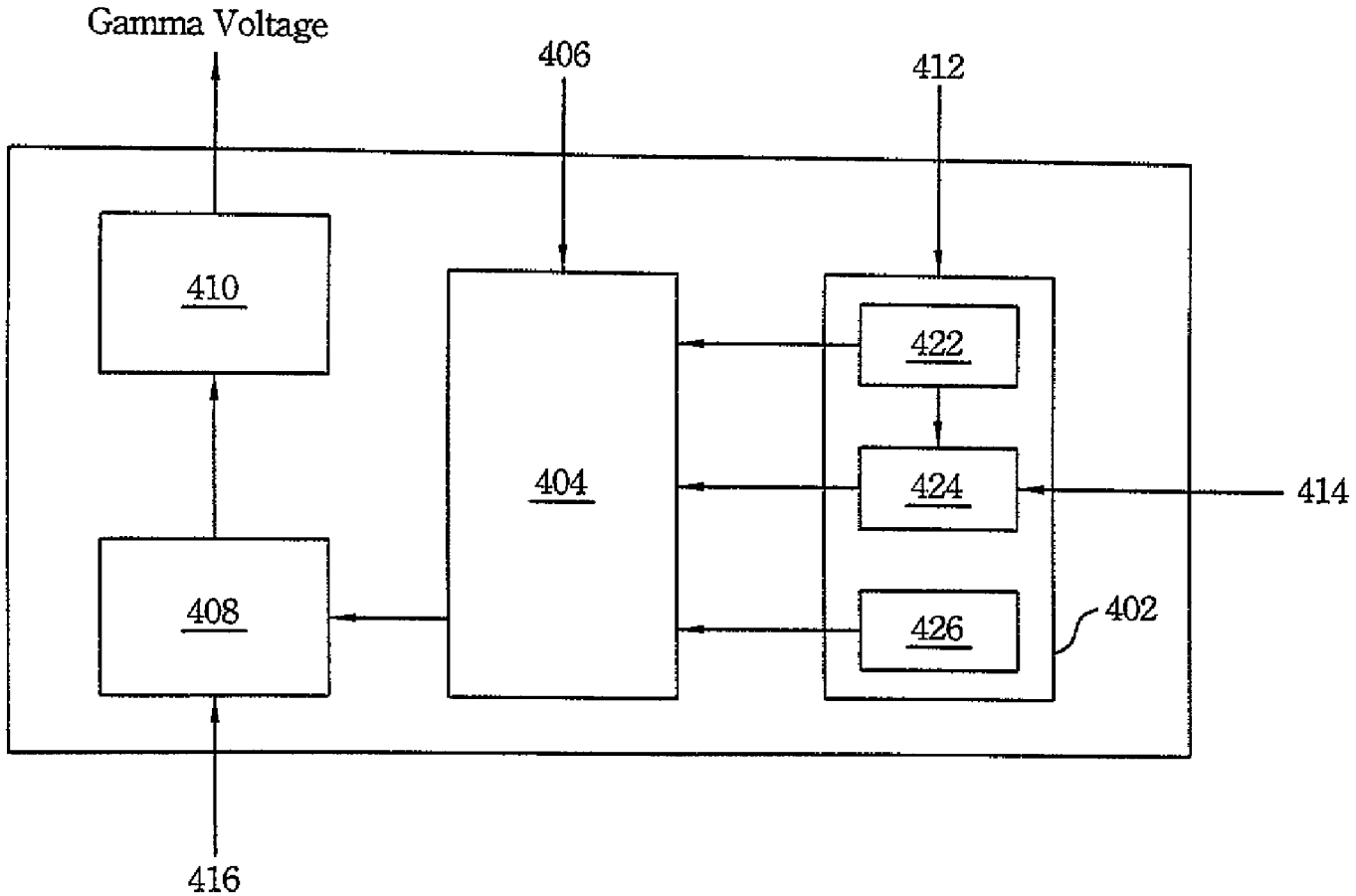
FIG. 4 illustrates the block diagram of the Gamma voltage generation circuit according to the preferred embodiment of the present invention.
Figure 5:
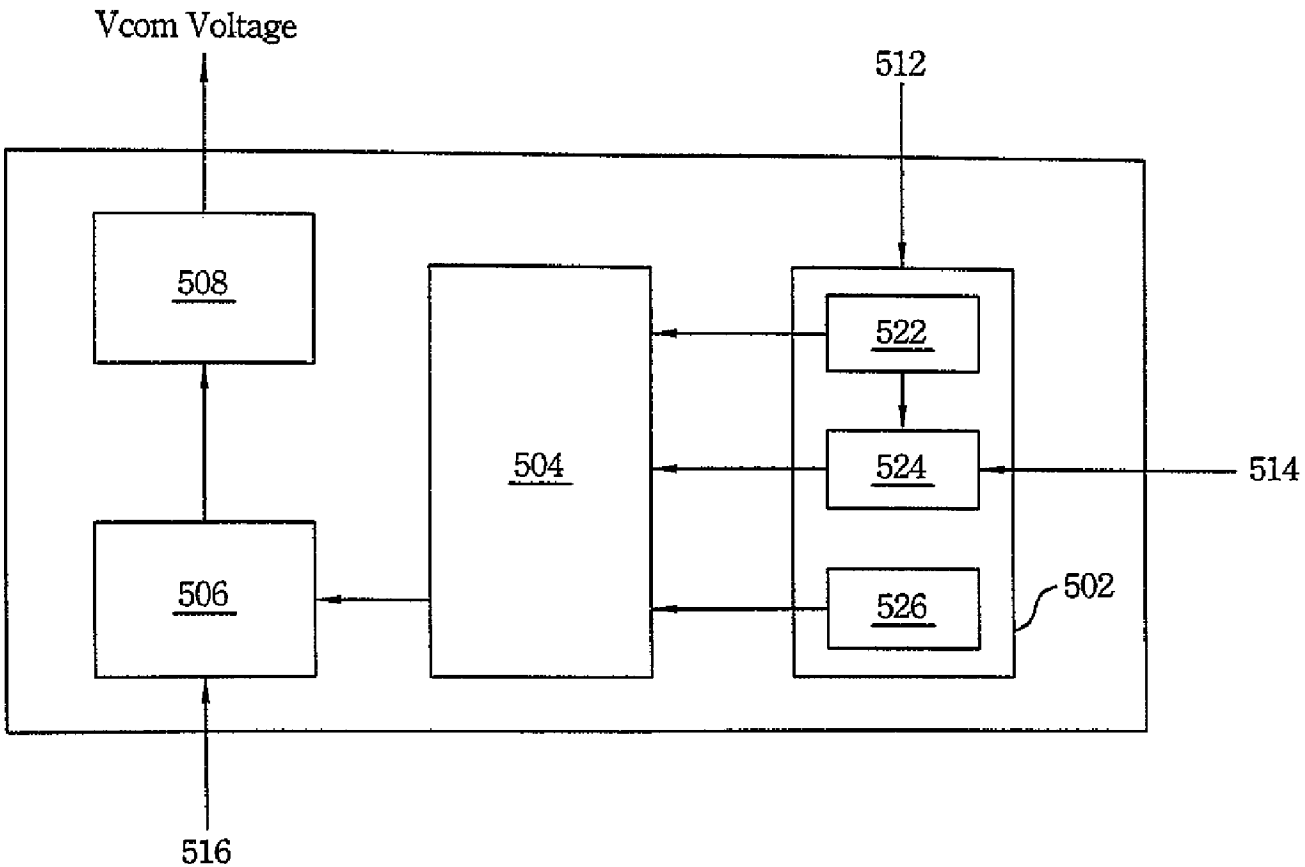
FIG. 5 illustrates the block diagram of the Vcom voltage generation circuit according to the preferred embodiment of the present invention.

In order to make the illustration of the present invention more explicit and complete, the following description is stated with reference to FIGS. 3 through 5.

Reference is made to FIG. 3 illustrating a diagram of driving system according to the source driver circuit/chip of the preferred embodiment of the present invention. Each source driver chip receives pixel values (not shown) and outputs driving voltages corresponding to the pixel values according to a plurality of Gamma voltages. As shown in FIG. 3, a Vcom voltage generation circuit 314 and a Gamma voltage generation circuit 316 are both located in a source driver chip 306 in the preferred embodiment of the present invention. The Vcom voltage generation circuit 314 and the Gamma voltage generation circuit 316 generate a Vcom voltage and a Gamma voltage, respectively. Furthermore, the source driver chips (306, 308, 310, 312) also generate and send out at least one Gamma voltage, respectively, and receive other Gamma voltages provided by other source driver chips. In other words, at least one of the Gamma voltages (Gamma 1~4) is generated by one of the source driver chips (306~312). Besides, each of the source driver chips also send out a Vcom voltage and the Vcom voltage can be sent to a panel via a tape (not shown in the drawing). The detail of how the Gamma voltage generation circuit 316 and the Vcom voltage generation circuit 314 in the source driver chip function will be described as follows.

Reference is made to FIG. 4 illustrating the block diagram of the Gamma voltage generation circuit according to the preferred embodiment of the present invention. The Gamma voltage generation circuit is located in the source driver chip. As shown in FIG. 4, the Gamma voltage generation circuit comprises a voltage selecting module 402, a control module 404, a digital-to-analog converter 408 and an output buffer 410. The voltage selecting module 402 selects one of voltage values corresponding to the Gamma voltages according to a control signal 412. The control signal 412 may be a serial control bus signal sent from the timing controller. A register 422, a one-time-programming (OTP) memory 424 and a ROM 426 are set in the voltage selecting module 402. The voltage values corresponding to the Gamma voltages are stored into the register 422 according to the control signal 412 during development, testing or normal operation stage. It is also the one-time-programming (OTP) memory 424 or the ROM 426 that can be used to generate the voltage values. The setting of the OTP memory 424 can be programmed according to the data from the register 422 and be fixed through a testing input signal 414.

A chip select control signal 406 is inputted to the control module 404 to determine each source driver chip generates the corresponding Gamma voltage, respectively, since the Gamma voltage generation circuits are all the same in each source driver chip. That is, although the source driver chips are the same, just by controlling the chip select control signal 406 can make different Gamma voltage generation circuits generate different Gamma voltages as shown in FIG. 3. The chip select control signal 406 may be an address with at least one bit, and the bit number is based on the amount of the source driver chips. For example, if there are eight source driver chips, the address will be 3 bit.

The control module 404 generates a selection code according to the voltage value outputted from the voltage selecting module 402 and according to the chip select control signal 406 identifying a chip number of the source driver chip. The control module 404 may be a multiplexer. The digital-to-analog converter 408 generates the Gamma voltage of the current Gamma voltage generation circuit according to the selection code. Then, the Gamma voltage is outputted via the output buffer 410. The digital-to-analog converter 408 receives a plurality of reference voltages 416 that are filtered out the noise to generate the Gamma voltage. The digital-to-analog converter 408 may have a R2R structure.

It is noted that the Gamma voltage generation circuit of the present invention may also generate more than one Gamma voltage. It can be embodied by adding more sets of digital-to-analog converters and output buffers coupled to the control module.

Hence, a feature of the present invention is that the Gamma voltage generation circuit and the output buffer are set in each of the source driver chips.

Another feature of the present invention is that the Gamma voltage generation circuit generates at least one Gamma voltage to send to other source driver chips and receives other Gamma voltages from other source driver chips.

Still another feature of the present invention is that the control module in the Gamma voltage generation circuit generates a selection code according to the voltage value outputted from the voltage selecting module and according to the chip select control signal identifying a chip number of the source driver chip.

Similarly, reference is made to FIG. 5 illustrating the block diagram of the Vcom voltage generation circuit according to the preferred embodiment of the present invention. The Vcom voltage generation circuit is also located in the source driver chip. As shown in FIG. 5, the Vcom voltage generation circuit comprises a voltage selecting module 502, a control module 504, a digital-to-analog converter 506 and an output buffer 508. The voltage selecting module 502 selects one of the voltage values corresponding to the Vcom voltages according to a control signal 512. The control signal 512 may be a serial control bus signal sent from the timing controller. A register 522, a one-time-programming (OTP) memory 524 and a ROM 526 are set in the voltage selecting module 502. The voltage values corresponding to the Vcom voltages are stored into the register 522 according to the control signal 512 during development, testing or normal operation stage. It is also the one-time-programming (OTP) memory 524 or the ROM 526 that can be used to generate the voltage value. The setting of the OTP memory 524 can be programmed according to the data from the register 522 and be fixed through a testing input signal 514.

The control module 504 generates a selection code according to the voltage value outputted from the voltage selecting module 502. The control module 504 may be a multiplexer. The digital-to-analog converter 506 generates the Vcom voltage of the current Vcom voltage generation circuit according to the selection code. Then, the Vcom voltage is outputted via the output buffer 508. The digital-to-analog converter 506 receives a plurality of reference voltages 516 that are filtered out the noise to generate the Vcom voltage. The digital-to-analog converter 506 may have a R2R structure.

It is noted that there is no need to input the chip select control signal into the Vcom voltage generation circuit of the present invention since the Vcom voltage are the same in each source driver chip, so no certain Vcom voltage generation circuit need to be assigned to generate the Vcom voltage.

In the other alternative, one source driver chip generates the Vcom voltage for uses of the other source driver chips.

According to the aforementioned description, one advantage of the present invention is that the voltage generation circuit is set in each source driver chip to generate at least one Gamma voltage or a Vcom voltage.

According to the aforementioned description, yet another advantage of the present invention is that the Gamma voltage generation circuit in one source driver chip generates at least one Gamma voltage to send to other source driver chips and to receive other Gamma voltages from other source driver chips.

According to the aforementioned description, yet another advantage of the present invention is that the voltage generation circuit is cost effective and can simplify the layout of the system PCB board.

According to the aforementioned description, yet another advantage of the present invention is that the Gamma voltage is generated according to an address in a chip select control signal and according to signals sent from a timing controller.

As is understood by a person skilled in the art, the foregoing preferred embodiments of the present invention are illustrative of the present invention rather than limiting of the present invention. It is intended to cover various modifications and similar arrangements included within the spirit and scope of the appended claims, the scope of which should be accorded the broadest interpretation so as to encompass all such modifications and similar structure.

What is claimed is:

1. An apparatus for driving a display wherein each pixels of the display receives a driving voltage and a common voltage, and a luminance of each pixel is determined by a difference between the received driving voltage and the common voltage, the apparatus comprising:

a plurality of source driver chips, each of which receives a pixel value and outputs the driving voltage corresponding to the pixel value according to a plurality of gamma voltages and comprises a gamma voltage generation circuit used to generate at least one gamma voltage and transmits the at least one gamma voltage to other source driver chips;

wherein the at least one gamma voltage transmitted by each of the source driver chips is different from other gamma voltages generated by the other source driver chips, and each of the source drivers generates the driving voltage corresponding to the pixel value in accordance with the at least one gamma voltage generated thereby and the other gamma voltages generated by the other source driver chips.

2. The apparatus as claimed in claim 1, wherein the gamma voltage generation circuit comprises:

a voltage selecting module, comprising:

a register; and a memory;

a control module generating a selection code according to a chip select control signal identifying a chip number of the source driver chip and a voltage value output from the register or the memory; and at least one digital-to-analog converter outputting the gamma voltage according to the selection code.

3. The apparatus as claimed in claim 2, wherein the gamma voltage generation circuit further comprises:

at least one output buffer receiving the gamma voltage from the digital-to-analog converter and outputting the Gamma voltage.

4. The apparatus as claimed in claim 2, wherein the voltage selecting module comprises a register and the voltage value is stored into the register according to a control signal.

5. The apparatus as claimed in claim 4, wherein the control signal is sent from a timing controller.

6. The apparatus as claimed in claim 2, wherein the memory is a one-time-programming memory which is programmed to generate the voltage value.

7. The apparatus as claimed in claim 6, wherein the setting of the one-time-programming memory can be programmed according to the register in the voltage selecting module and be fixed through a testing input signal.

8. The apparatus as claimed in claim 2, wherein the voltage selecting module comprises a ROM storing the voltage value.

9. The apparatus as claimed in claim 2, wherein the control module may be a multiplexer.

10. The apparatus as claimed in claim 2, wherein the digital-to-analog converter receives a plurality of reference voltages to generate the gamma voltage.

11. The apparatus as claimed in claim 2, wherein the digital-to-analog converter has a R2R structure.

* * * * *